US007607398B2

(12) United States Patent
Tietze et al.

(10) Patent No.: US 7,607,398 B2
(45) Date of Patent: Oct. 27, 2009

(54) METHOD AND DEVICE FOR THE REGULATED FEED OF PULVERIZED FUEL TO AN ENTRAINED FLOW GASIFIER

(75) Inventors: Günter Tietze, Freiberg (DE); Stefanie Richter, Weissenborn (DE); Manfred Schingnitz, Freiberg (DE); Bernd Holle, Freiberg (DE)

(73) Assignee: Siemens Aktiengesellschaft, München (DE)

( * ) Notice: Subject to any disclaimer, the term of this patent is extended or adjusted under 35 U.S.C. 154(b) by 447 days.

(21) Appl. No.: 11/371,968

(22) Filed: Mar. 9, 2006

(65) Prior Publication Data

US 2007/0074643 A1 Apr. 5, 2007

(30) Foreign Application Priority Data

Oct. 4, 2005 (DE) ..... 10 2005 047 583

(51) Int. Cl.
*F23D 1/00* (2006.01)

(52) U.S. Cl. ..... 110/347; 110/348; 110/101 CF; 110/101 R

(58) Field of Classification Search ..... 110/185, 110/186, 188, 189, 193, 101 C, 101 CF, 101 CD, 110/101 R, 104 R, 105, 347, 348; 406/19
See application file for complete search history.

(56) References Cited

U.S. PATENT DOCUMENTS 4,146,370 A 3/1979 VAN Herwijnen et al.
4,501,156 A 2/1985 Kretschmer et al.
4,521,139 A * 6/1985 Kretschmer et al. ..... 406/19
4,758,118 A * 7/1988 Rachner et al. ..... 406/24

FOREIGN PATENT DOCUMENTS

| | | |
|---|---|---|
| CZ | 254104 | 1/1988 |
| DE | 22 14 737 | 9/1973 |
| DE | 26 54 662 | 6/1977 |
| DE | 28 31 208 | 3/1979 |
| DE | 28 34 208 | 3/1979 |
| GB | 1 369 952 | 10/1974 |
| GB | 2 004 993 | 4/1979 |
| SU | 1702183 | 12/1991 |

* cited by examiner

*Primary Examiner*—Kenneth B Rinehart
(74) *Attorney, Agent, or Firm*—Collard & Roe, P.C.

(57) ABSTRACT

A method and device for metering and feeding pulverized fuels under pressure into gasification reactors, with the pulverized fuel being supplied alternately from an operational bunker through pressurized sluices to a metering tank, in the bottom of which a dense fluidized bed is formed by introducing fluidizing gas through a turbulence plate, with transport pipes immersed in the fluidized bed horizontally or vertically, by which the fluidized fuel is fed continuously through burners to a pressurized gasification reactor. By feeding in auxiliary gas in the immediate vicinity of the transport line inlet into the metering tank or the transport lines, the pressure differential between the metering tank and the gasification reactor is controlled and is utilized as a control parameter for pulverized fuel transport.

13 Claims, 3 Drawing Sheets

METHOD AND DEVICE FOR THE REGULATED FEED OF PULVERIZED FUEL TO AN ENTRAINED FLOW GASIFIER

BACKGROUND OF THE INVENTION

1. Field of the Invention

This invention relates to a method for the regulated feed of pulverized fuel for pressurized gasification in an entrained flow gasifier, and a device for implementing the method.

Pulverized fuel means coals of highly varied degrees of carbonization pulverized to the fineness of dust, such as bituminous coals and lignites, pulverized biomasses, cokes produced by thermal pretreatment including petroleum coke but also combustible residues and wastes from industry, domestic sources, and business trades that can be pulverized.

2. The Prior Art

Methods for pressurized gasification of dust-like fuels are known, in which the dust is fed through a pressurized sluice tank to a metering tank at gasification pressure, from which the pulverized fuel is fed through transport lines to the burner of the gasification reactor as a dust-carrier gas suspension with high loading densities between 250 and 450 kg/m$^3$. Entrained flow gasifiers, gasifiers for dust-like fuels, and direct-feed tuyeres for blast furnaces are considered to be gasification reactors.

Any reducing and neutral gases that are free of condensable constituents, for example such as water vapor, and whose content of free oxygen is <6 vol. %, can be used as pressurizing gases for the pressurized sluices. German Patent No. DE-OS 26 54 662, Czech Republic Patent No. CZ 254104, Soviet Union Patent No. SU 170 2183 A1, and German Patent No. DE 28 31 308 C2 may be mentioned here. A problem with this technology is that the amount of dust flowing per unit time must be constant in order to be able to perform reliably in the necessary temperature range for the process of gasification that occurs with an oxidizing medium containing free oxygen. In particular, the discontinuous loading of the metering tank from the pressurized sluices produces pressure fluctuations that have adverse effects on the pressure differential that serves as the driving force for conveying between the metering tank and the burners of the gasification reactor.

SUMMARY OF THE INVENTION

It is therefore an object of the invention to provide a method for the constant infeed of pulverized fuel, with which fluctuations of pressure differentials between the metering tank and burners of the gasification reactor can be compensated.

This object is accomplished by a method for metering and feeding pulverized fuels under pressure into a gasification reactor or another component, wherein the pulverized fuel is fed alternately from an operational bunker through pressurized sluices to a metering tank, in the bottom of which a dense fluidized bed is formed by feeding in fluidizing gas through a turbulence plate. Immersed horizontally or vertically in the fluidized bed are transport pipes by which the pulverized fuel is fed continuously through burners to a pressurized user, for example a gasification reactor. An auxiliary gas is introduced into the transport line to control pressure differentials between the metering tank and the user, for example the gasification reactor. To determine how much auxiliary gas must be introduced, the dust flow is measured in the transport line between the metering tank and the gasification reactor, and the necessary amount of auxiliary gas is set by instruments with reference to the value obtained. The stream of auxiliary gas is preferably fed in near the inlet of each transport line. It is beneficial to place another auxiliary gas inlet and outlet in the metering tank above the pulverized fuel bed. To do this, appropriate auxiliary gas lines and instruments are connected to the metering tank.

It is also beneficial to regulate the flow velocity of the dust stream in the transport lines within the range of 2 to 8 m/s. It is possible to introduce this technology of pulverized fuel infeed to other components also, for example to the tuyeres of a blast furnace, since reactions similar to those in a gasification reactor take place there.

The invention has the advantage that fluctuations of the pressure differential between the metering tank and burners of the gasification reactor serving as the driving force for dust flow can be compensated by auxiliary gas infeeds to the transport lines and auxiliary gas inlets and outlets to and from the head space of the metering tank, and thus a constant dust flow rate can be assured. The transport lines leading into the bottom of the metering tank can be positioned horizontally or vertically, from above or below.

The infeed of auxiliary gas opens up the ability to maintain metering accuracy with fluctuations of the filled level. One or more transport lines can be put in place for the dust stream. The pressure in the transport lines can be between 1 and 60 bar. The diameter of the transport lines can be varied between 10 and 70 mm, depending on the transport output. The pulverized fuel can also be supplied to users other than a gasification reactor, for example the tuyeres of a blast furnace.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
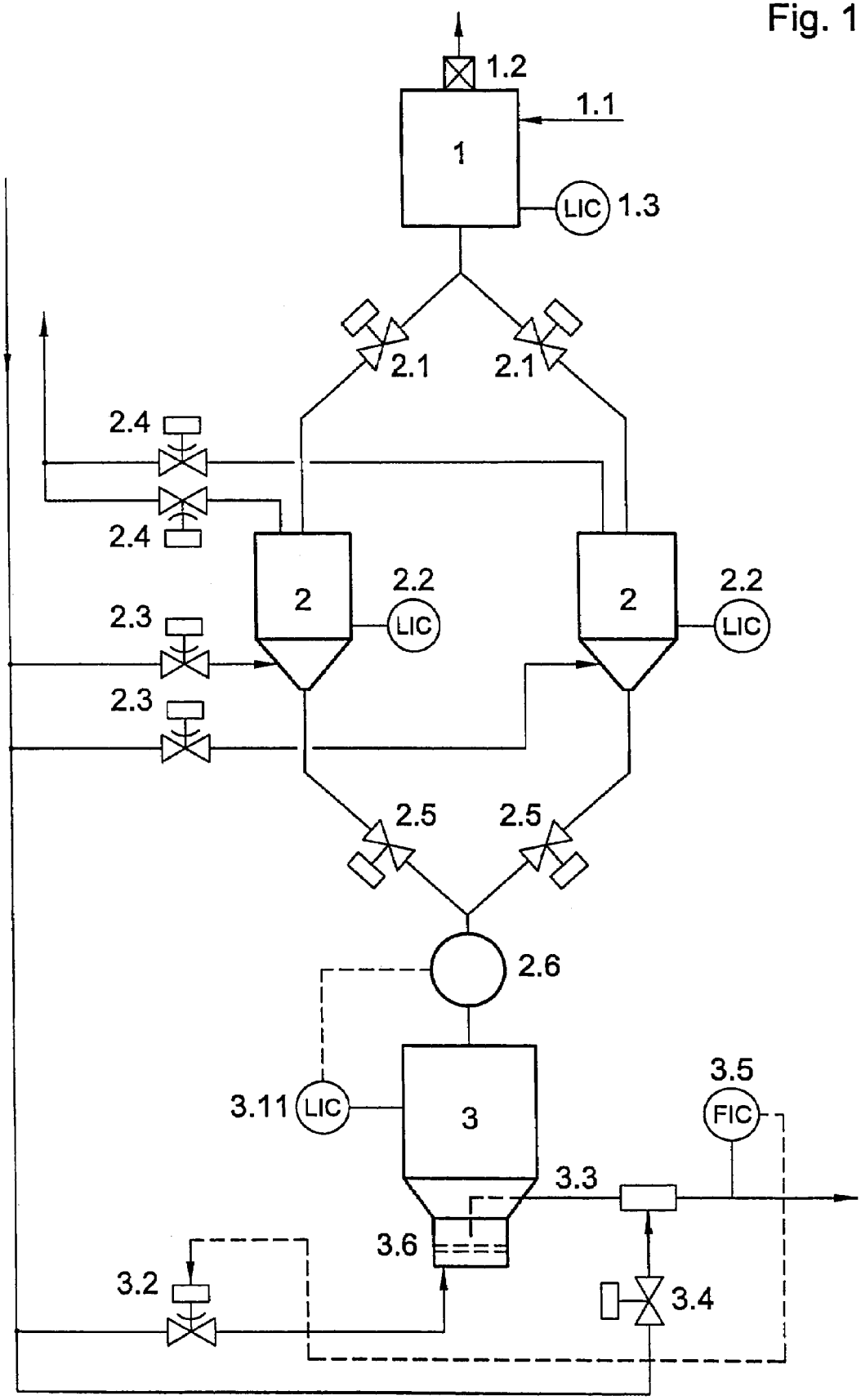
FIG. 1 shows a diagram of the technology of dust metering under pressure according to the prior art.

Referring now in detail to the drawings, FIG. 1 shows a diagram of the technology for dust transport under pressure as it is known in the prior art.

An entrained flow gasifier (not shown) is operated under a pressure of 40 bar with an output of 500 MW. For this purpose, bituminous coal dust brought to a grain size of <200 μm is fed in at a rate of 90 Mg/h. The pulverized fuel is first fed to an operational bunker 1 through the transport line 1.1 by normal conveyance at low concentration, with the amount supplied being regulated in the level control 1.3. The transport gas is filtered in the filter 1.2 and released to the atmosphere or recompressed and again utilized for conveyance. Since the gasification reactor 4 is operated at 40 bar, the pulverized fuel has to be brought to this pressure. To do this, pressure sluices 2 are loaded alternately with dust and pressurized with inert gas through the lines 2.3. Level regulators 2.2 prevent overfilling. The fittings 2.1 provide pressure-tight blocking toward the operational bunker 1. When the level in the metering tank 3 has dropped to a minimum value, it is replenished from pressurized sluices, 2. The fittings 2.5 are opened to do this. After pressurized sluices 2 are emptied, they are depressurized to atmospheric pressure through 2.4 and are again filled. Depending on the amount of dust to be transported, there can be one or more pressurized sluices 2. A pressurized star feeder 2.6 can be placed between pressurized sluices 2 and metering tank 3 to slow down the flow of dust. Replenishment into metering tank 3 is regulated by level control 3.11. The pressurized sluices 2 are replenished with pulverized fuel from bunker 1 three times every hour, while metering tank 3 is replenished 6 times every hour with 2 pressurized sluices, with 15 Mg being transported each time. The dust transport line 3.3 extends vertically into the bottom of metering tank 3, in which a very dense fluidized bed 3.8 with densities up to 450 kg/m$^3$ is produced through a turbulence plate 3.6 by feeding in fluidizing gas 3.2. When a pressure differential is applied between metering tank 3 and the gasification reactor 4, the pulverized fuel-in-gas suspension controlled by 3.5 flows through the transport line 3.3 to the gasification reactor 4.

Figure 2:
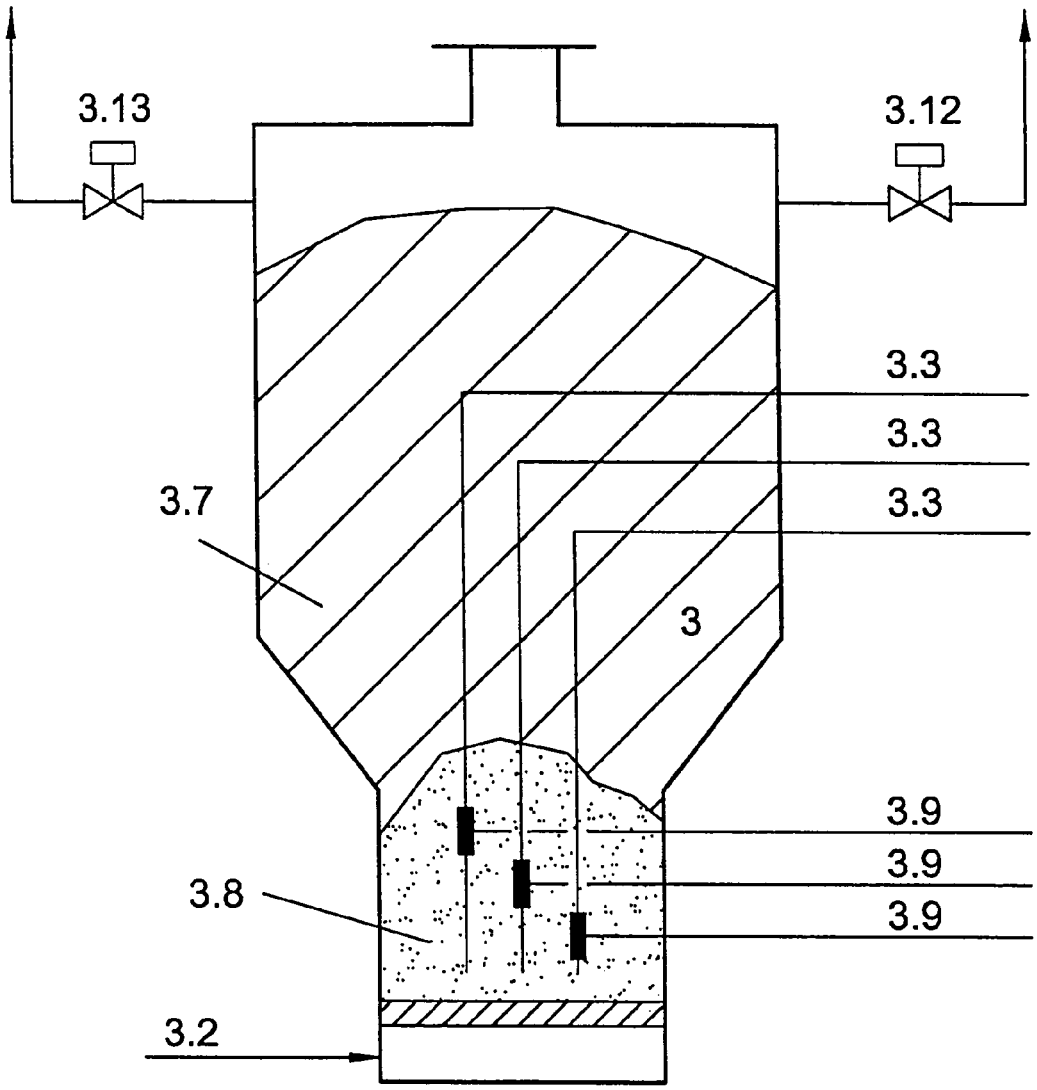
FIG. 2 shows a schematic representation of the metering tank according to the invention.
Figure 3:
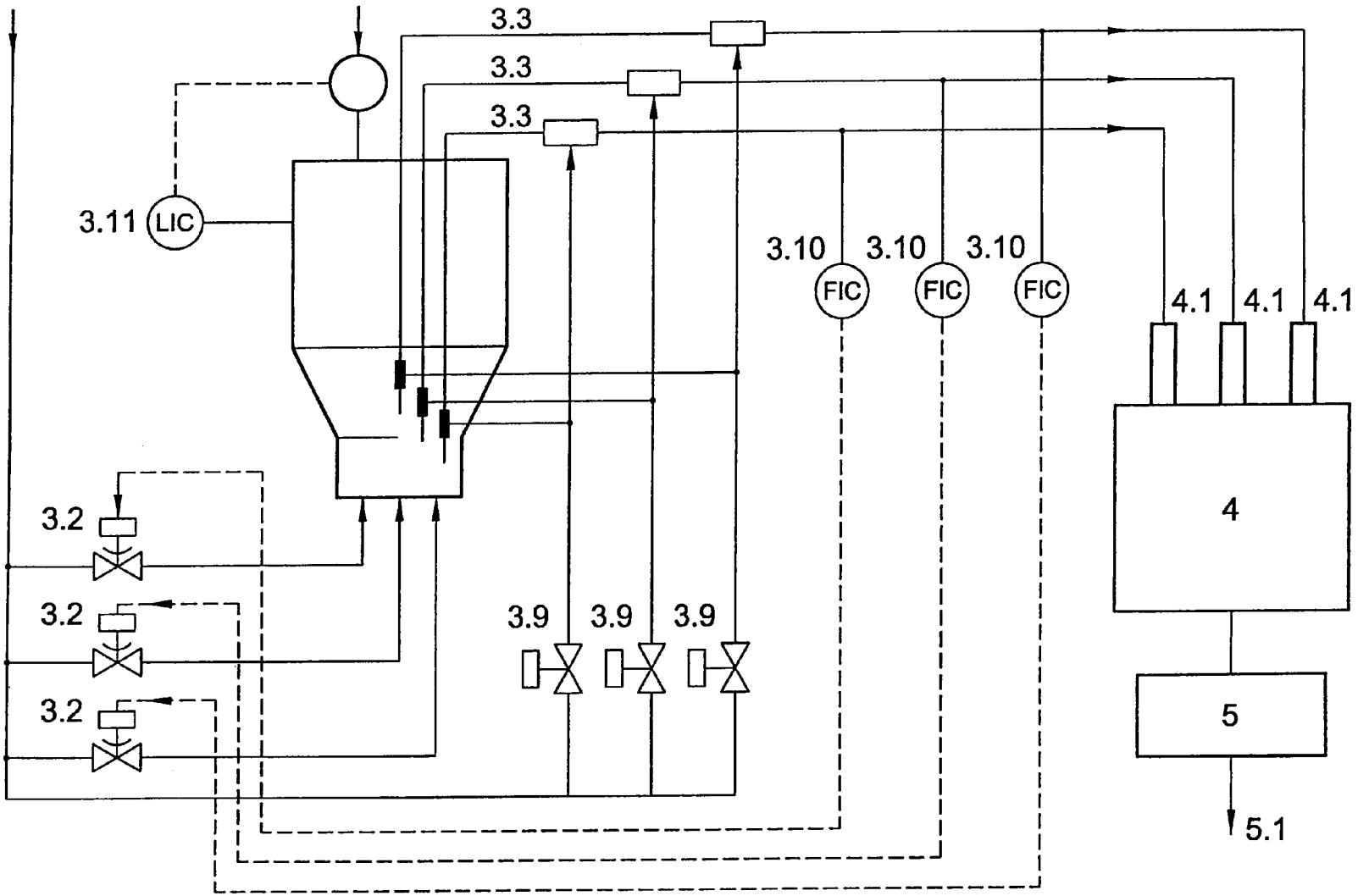
FIG. 3 shows a schematic representation of the infeed of pulverized fuel to a pressurized gasification reactor according to the invention.

According to FIG. 2, three transport lines 3.3 are in operation, each with an output of 30 Mg per hour. To compensate for pressure fluctuations from the operation of the gasification reactor 4 and from the six-fold replenishment from the pressurized sluices 2, additional auxiliary gas is fed into the transport lines 3.3 through lines 3.9, and additional auxiliary gas is fed to and discharged from the head space of metering tank 3 through the lines 3.12 and 3.13. According to FIG. 3, the auxiliary gas can be fed in directly beyond the inlet of transport line 3.3, but also at other places or at multiple places. The amount of dust flowing in transport lines 3.3 is measured and regulated by 3.10 by controlling the amount of fluidizing gas with control instrument 3.2, with the transport velocity in the pipes 3.3 being between 2 and 8 m/s and with the transport line diameter being 65 mm. The pulverized fuel flowing through the transport line 3.3 is fed through gasification burner 4.1 to gasification reactor 4, and is reacted using a gasification medium containing free oxygen to produce a crude synthesis gas, which is sent through line 5.1 by direct or indirect cooling in 5 to further treatment steps.

Accordingly, while only a few embodiments of the present invention have been shown and described, it is obvious that many changes and modifications may be made thereunto without departing from the spirit and scope of the invention.

LIST OF REFERENCE SYMBOLS USED

1. Supply bunker for coal dust
1.1 Coal dust line
1.2 Filter
1.3 Level control
2. Pressurized sluices
2.1 Fittings for dust infeed
2.2 Level control
2.3 Control fittings for pressurization gas infeed
2.4 Control fittings for depressurized gas release
2.5 Fittings for dust infeed
2.6 Pressurized star feeder
3. Metering tank
3.1 Level control
3.2 Control fitting for fluidizing gas
3.3 Transport line for dust stream
3.4 Control fitting for auxiliary gas infeed
3.5 Quantity control for dust stream
3.6 Turbulence plate in the metering tank
3.7 Pulverized fuel bed in the metering tank
3.8 Fluidized bed zone in the metering tank
3.9 Auxiliary gas infeed into the transport line
3.10 Measurement and regulation of the dust stream
3.11 Level control
3.12 Auxiliary gas infeed
3.13 Auxiliary gas discharge
4. Gasification reactor
4.1 Burner of the gasification reactor
5. Crude gas cooling by quenching
5.1 Crude gas discharge for gas purification

What is claimed is:

1. A method for constant infeed of pulverized fuels under pressure into gasification reactors, comprising:

supplying the pulverized fuel alternately from an operational bunker through pressurized sluices to a metering tank;

introducing a fluidizing gas through a turbulence plate into a bottom of the metering tank, to form a dense fluidized bed from the pulverized fuel and fluidizing gas, with a transport pipe immersed in the fluidized bed horizontally or vertically, feeding the fuel from the metering tank continuously through the transport pipe via a burner to a pressurized gasification reactor or other component, wherein fuel flow is measured in the transport pipe between the metering tank and the gasification reactor; and separately from the fluidizing gas, feeding in auxiliary gas in an immediate vicinity of a transport pipe inlet into the metering tank below a level control of the pulverized fuel in an amount based on the value of the measured fuel flow obtained, wherein the amount of auxiliary gas fed in for a constant fuel flow is set by a control fitting.

2. A method pursuant to claim 1, wherein to further control the pressure differential between the metering tank and gasification reactor or other component, further auxiliary gas is also fed to and released from a head space of the metering tank.

3. A method pursuant to claim 1, wherein flow velocity of the fluidized fuel in the at least one transport pipe is in the range of 2 to 8 m/s.

4. A method pursuant to claim 1, wherein the fluidized fuel is fed via the at least one transport pipe to said other component, which comprises tuyeres of a blast furnace.

5. The method according to claim 1, wherein the auxiliary gas is fed into the transport pipe.

6. A device for constant infeed of pulverized fuel under pressure into gasification reactors, comprising:

a supply bunker;

pressurized sluices connected to the supply bunker for feeding fluidizing gas;

at least one transport line connected to the pressurized sluices;

a metering tank connected to the pressurized sluices and the transport line via at least one transport line inlet;

a turbulence plate for feeding in fluidizing gas to the metering tank;

an infeed for feeding auxiliary gas into the metering tank separately from the fluidizing gas, said infeed being disposed beneath a level control of the pulverized fuel; and a gasification reactor connected to the transport line;

means for measuring the amount of gas in the transport line between the metering tank and the gasification reactor; and a control fitting for setting a necessary amount of auxiliary gas based on the measured amount of gas in the transport line.

7. A device pursuant to claim 6, further comprising additional lines for further auxiliary gas in a head space of the metering tank.

8. A device pursuant to claim 6, further comprising a pressurized star wheel feeder between the pressurized sluice and the metering tank to smooth filling processes.

9. A device pursuant to claim 6, wherein there are two or more pressurized sluices.

10. A device pursuant to claim 6, wherein there are multiple transport lines between the metering tank and the gasification reactor.

11. A device pursuant to claim 6, wherein a diameter of each of the transport lines is between 10 and 70 mm.

12. A device pursuant to claim 6, further comprising lines for feeding auxiliary gas between the gasification reactor and the metering tank, said lines opening into the at least one transport line.

13. The method according to claim 6, wherein the infeed for the auxiliary gas is in the transport pipe.

* * * * *

UNITED STATES PATENT AND TRADEMARK OFFICE

CERTIFICATE OF CORRECTION

PATENT NO. : 7,607,398 B2
APPLICATION NO. : 11/371968
DATED : October 27, 2009
INVENTOR(S) : Tietze et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 452 days.

Signed and Sealed this

Twelfth Day of October, 2010

David J. Kappos

David J. Kappos
*Director of the United States Patent and Trademark Office*